US007162839B2

(12) United States Patent
Ohno et al.

(10) Patent No.: US 7,162,839 B2
(45) Date of Patent: Jan. 16, 2007

(54) NON-SLIP MATERIAL

(75) Inventors: Shunji Ohno, Tokyo (JP); Kazumichi Iwasa, Tokyo (JP); Norio Nakajima, Tokyo (JP); Masanori Tsuji, Tokyo (JP); Tsuyoshi Doi, Tokyo (JP); Yoshihisa Kouzu, Tokyo (JP); Yoshihiro Agarihama, Kobe (JP); Shinya Ura, Osaka (JP); Hideyuki Miyake, Isehara (JP)

(73) Assignee: Shin Caterpillar Mitsubishi Ltd., Tokyo (JP)

( * ) Notice: Subject to any disclaimer, the term of this patent is extended or adjusted under 35 U.S.C. 154(b) by 0 days.

(21) Appl. No.: 10/475,167

(22) PCT Filed: Nov. 11, 2002

(86) PCT No.: PCT/JP02/11740

§ 371 (c)(1),
(2), (4) Date: Oct. 17, 2003

(87) PCT Pub. No.: WO03/060257

PCT Pub. Date: Jul. 24, 2003

(65) Prior Publication Data

US 2004/0154254 A1 Aug. 12, 2004

(30) Foreign Application Priority Data

Jan. 9, 2002 (JP) ..... 2002/002650

(51) Int. Cl.
*E01C 11/24* (2006.01)

(52) U.S. Cl. ..... 52/180; 52/177; 52/630; 428/597

(58) Field of Classification Search ..... 52/177, 52/180, 181, 630, 673, 675, 674; 428/597

See application file for complete search history.

(56) References Cited

U.S. PATENT DOCUMENTS

| | | | | | |
|---|---|---|---|---|---|
| 538,467 | A | * | 4/1895 | Schaper | 52/675 |
| 937,415 | A | * | 10/1909 | Cairns | 280/169 |
| 1,044,283 | A | * | 11/1912 | Stranger | 72/325 |
| 1,091,214 | A | * | 3/1914 | Gruber | 280/169 |
| 1,215,235 | A | * | 2/1917 | Atwood | 52/675 |
| 1,959,101 | A | * | 5/1934 | Hasselquist | 72/327 |
| 2,004,747 | A | * | 6/1935 | Daly | 428/613 |
| D140,623 | S | * | 3/1945 | Harper | D25/160 |
| 2,975,977 | A | * | 3/1961 | Chodacki et al. | 238/14 |
| 4,133,481 | A | * | 1/1979 | Bennett | 238/14 |
| 4,343,119 | A | * | 8/1982 | Bahnfleth | 52/180 |
| 4,709,519 | A | * | 12/1987 | Liefer et al. | 52/98 |

(Continued)

FOREIGN PATENT DOCUMENTS

JP U 4-61151 5/1992

(Continued)

*Primary Examiner*—Jeanette Chapman
(74) *Attorney, Agent, or Firm*—Oliff & Berridge, PLC

(57) ABSTRACT

The invention provides a slip stopper which achieves a great slip stopping effect, and can be used for a location where a problem occurs if a through hole is opened therein. In a protruding portion that protrudes from the upper surface of a steel plate in the plate thickness direction, a concave portion and drain channels, that lead to the steel plate upper surface from the concave portion, are formed. The inner surface of the concave portion and the groove side surfaces of drain channels are formed by shear planes which extend substantially perpendicular to the steel plate upper surface, and are obtained by half blanking that does not open a through hole in the steel plate.

8 Claims, 13 Drawing Sheets

U.S. PATENT DOCUMENTS

| | | | | | |
|---|---|---|---|---|---|
| 4,998,391 | A | * | 3/1991 | Connew | 52/179 |
| 5,103,608 | A | * | 4/1992 | Andreo | 52/179 |
| 5,205,088 | A | * | 4/1993 | Mueller | 52/24 |
| 5,499,888 | A | * | 3/1996 | Hawkes | 404/19 |
| 5,538,183 | A | * | 7/1996 | McGee | 238/14 |
| 5,653,071 | A | * | 8/1997 | Iwami et al. | 52/181 |
| 5,735,155 | A | * | 4/1998 | Morton et al. | 72/14.8 |
| 5,807,021 | A | * | 9/1998 | Aaron | 404/19 |
| 6,141,917 | A | * | 11/2000 | Mueller | 52/24 |
| 7,021,109 | B1 | * | 4/2006 | Ohno et al. | 72/325 |

FOREIGN PATENT DOCUMENTS

| | | |
|---|---|---|
| JP | A 5-85267 | 4/1993 |
| JP | A 6-322938 | 11/1994 |
| JP | A 2002-45928 | 2/2002 |

* cited by examiner

NON-SLIP MATERIAL

This application claims priority from JP 2002-002650 filed Jan. 9, 2002, through PCT/JP02/11740 filed Nov. 11, 2002. The material found in both documents is incorporated herein by reference thereto.

TECHNICAL FIELD

The invention relates to the technical fields of a slip stopper employed for stepping surfaces of floors, passageways, and steps, etc., provided in building structures and construction machines.

BACKGROUND ART

Generally, a slip stopper with a slip stopping function is occasionally used for floors, passageways, and stairs in building structures, floors and steps of buses, trucks and special vehicles, decks of railroad vehicles and ships, and scaffolding at construction sites. Such a slip stopper, for example, a slip stopper as shown in FIGS. 12(A)–12(C), has been conventionally known. This is a so-called striped steel plate, the steel plate has a plurality of projections 10 molded in a continuous patterned shape. A corresponding slip stopping effect can be expected in the case of normal scaffolding, however, the height of the projections 10 of this striped steel plate is low and is curved, so that a more reliable slip stopper is required for works at heights, scaffolding that is exposed to rain or mud, or when workers step on a cover covering the upper surface of a construction machine as a stepping surface during maintenance.

Therefore, as shown in FIGS. 13(A) and 13(B), a slip stopper has been provided in which slip stopping parts 12 having raised edges, formed by the marginal section of a through hole 11 stamped out into a circle shape or a star shape, are formed in a running pattern. In this slip stopper, the raised portions of the slip stopping part 12 can be made sufficiently high, and sharp shear planes are formed by means of stamping-out, so that a great slip stopping effect can be obtained.

If the slip stopper having the through hole stamped out is used as it is as, for example, for a cover to cover the upper surface of a construction machine, problems such that rainwater or dirt enters the inside of the cover, heated air from an engine blows upward from the cover, or noise escape are inevitable. Therefore, a double structure is created comprising a flat steel plate fixed to the lower side of the slip stopper to prevent the abovementioned problems. However, the double structure increases production processes and costs in comparison with the single structure, and further poses a problem in that mud or dust entering the through hole of the slip stopper accumulates between the slip stopper and the lower side flat steel plate or collects in the through hole, and makes cleaning difficult. These problems are to be solved by the invention.

SUMMARY OF THE INVENTION

In view of the abovementioned circumstances, the invention has been developed to solve the problems. In an embodiment, in a protruding portion that protrudes in a plate thickness direction from the plate surface of a metal plate, a concave portion is formed by shear planes which face almost perpendicularly to the plate surface of the metal plate and are obtained by half blanking that does not open a through hole in the metal plate.

This structure shows a great slip stopping effect, and provides a slip stopper that can also be used for a location which may pose a problem if a through hole is opened therein.

In this structure, the protruding portion can be formed to have a mountain shape that becomes high at the central portion and lowers toward the marginal section and has a roughly arc-shaped section, and, for example, the concave portion can be formed at the central portion of the protruding portion by using the shear planes as inner circumferential surfaces. Furthermore, by forming drain channels shaped into concave grooves leading to the plate surface of the metal plate from the concave portion, the slip stopping effect can be prevented from being lost due to the accumulation of water or dirt in the concave portion.

In this structure, the drain channels are radially formed in a plurality from the concave portion. Further, the slip stopping effect can be increased by forming the channel side surfaces of the drain channels by shear planes which face perpendicularly to the plate surface of the metal plate and are obtained by half blanking that does not open a through hole in the metal plate.

The slip stopper is useful when it is used as, for example, stepping surfaces provided on a construction machine. That is, the invention is widely applicable to slip stoppers to be used for various footings requiring a device to prevent slipping, such as stepping surfaces of construction machines, floors, passageways, and stairs of buildings, floors and steps of buses, trucks and special vehicles, decks of railroad vehicles and ships, and scaffolding at construction sites, and is useful in cases where a great slip stopping effect is required, the slip stopper is used for locations at which a problem occurs if a through hole is opened therein, or it is demanded to prevent the slip stopping effect from being lost due to accumulation of water and dirt.

BRIEF DESCRIPTION OF THE DRAWINGS

The invention will be described with reference to the drawings, in which.

DETAILED DESCRIPTION

Figure 1:
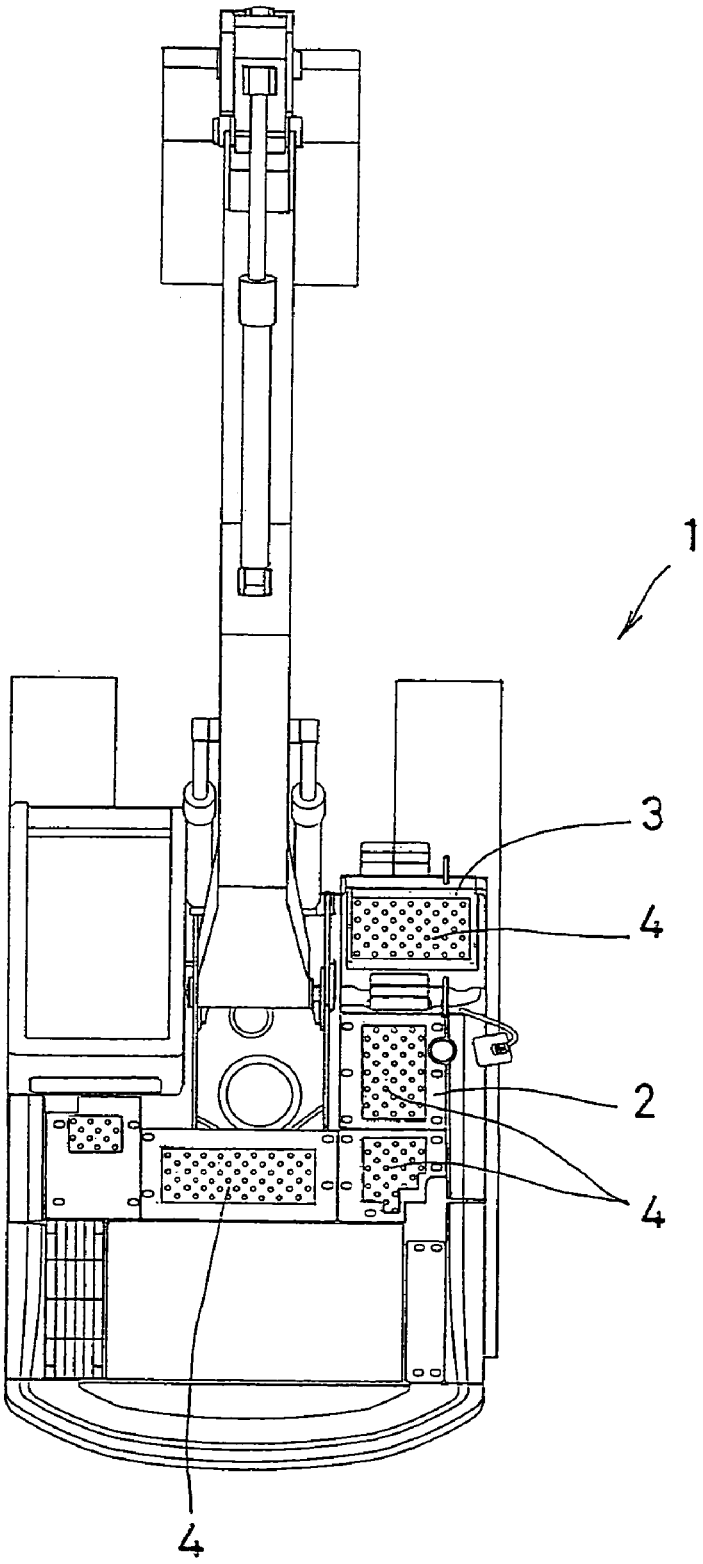
FIG. 1 is a plan view of a construction machine.

In the drawings, 1 denotes a construction machine (hydraulic excavator), and the construction machine is constructed so that the upper surfaces of a cover 2 covering the machine upper surface and a tool box 3 are formed as stepping surfaces on which a worker can walk or step during maintenance, and a slip stopper 4 to which the disclosure is applied is for these stepping surfaces.

Figure 2:
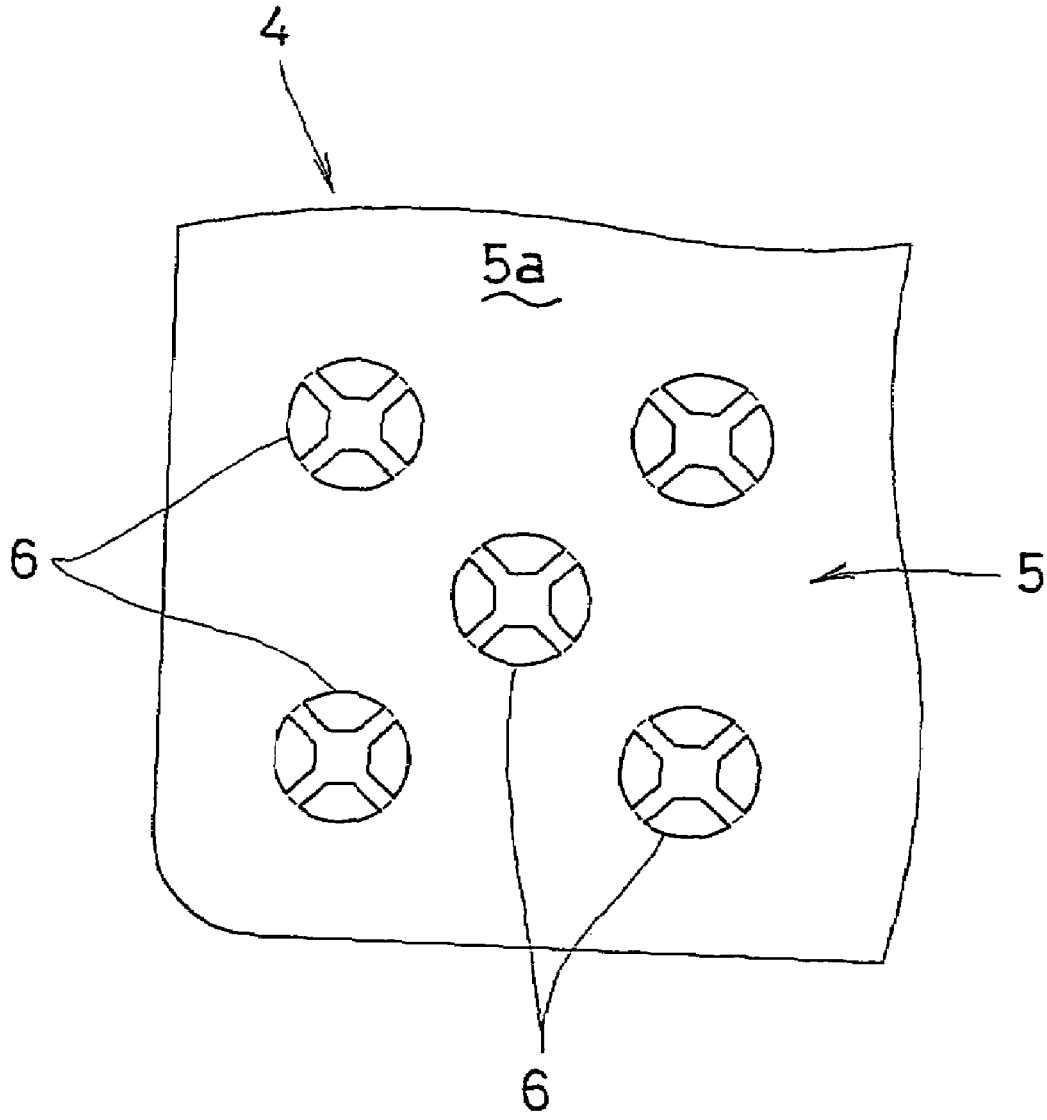
FIG. 2 is a partial plan view of a slip stopper.
Figure 3:
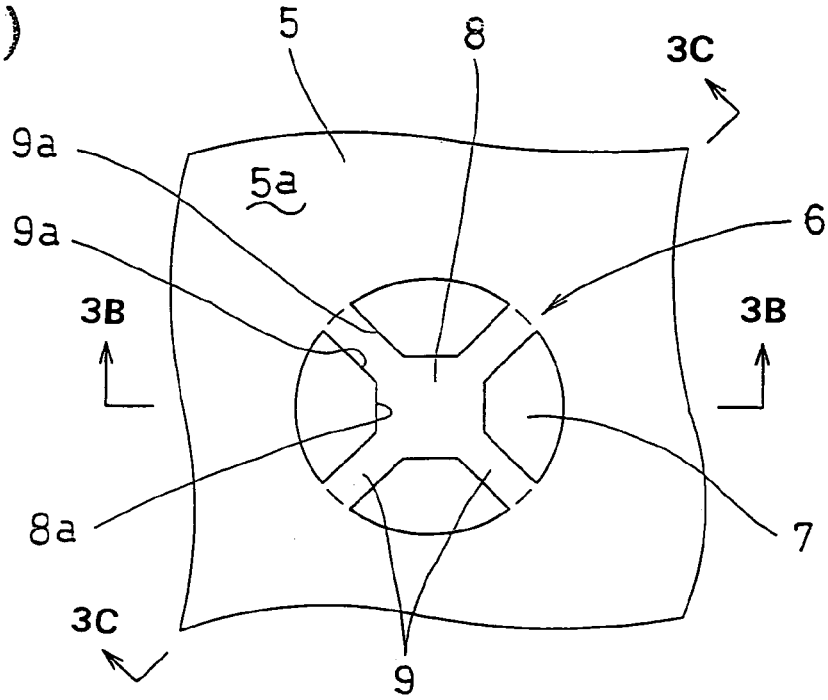
FIG. 3(A) is a plan view of a slip stopping part.
FIG. 3(B) is a 3B—3B sectional view of FIG. 3(A)
FIG. 3(C) is a 3C—3C sectional view of FIG. 3(A)
Figure 3:
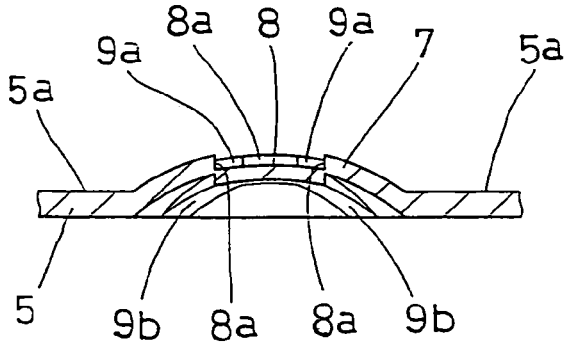
Figure 3:
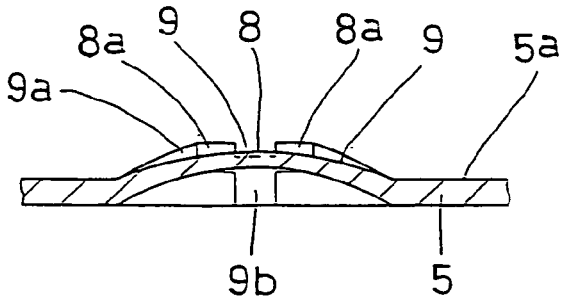
Figure 4:
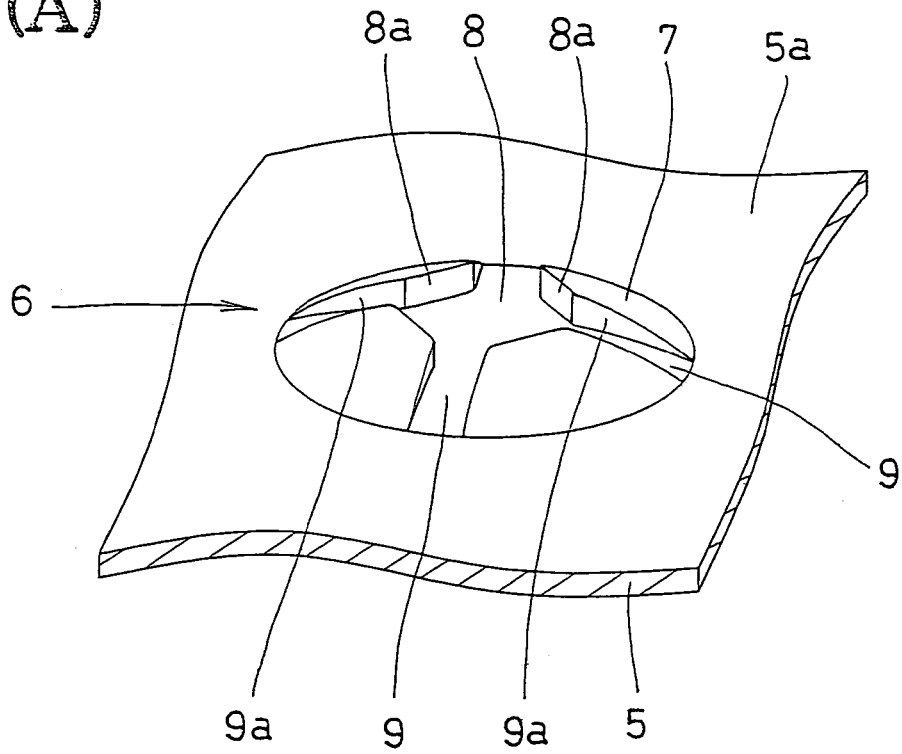
FIG. 4(A) is a perspective plan view of the slip stopping part.
FIG. 4(B) is a perspective bottom view of the slip stopping part.
Figure 4:
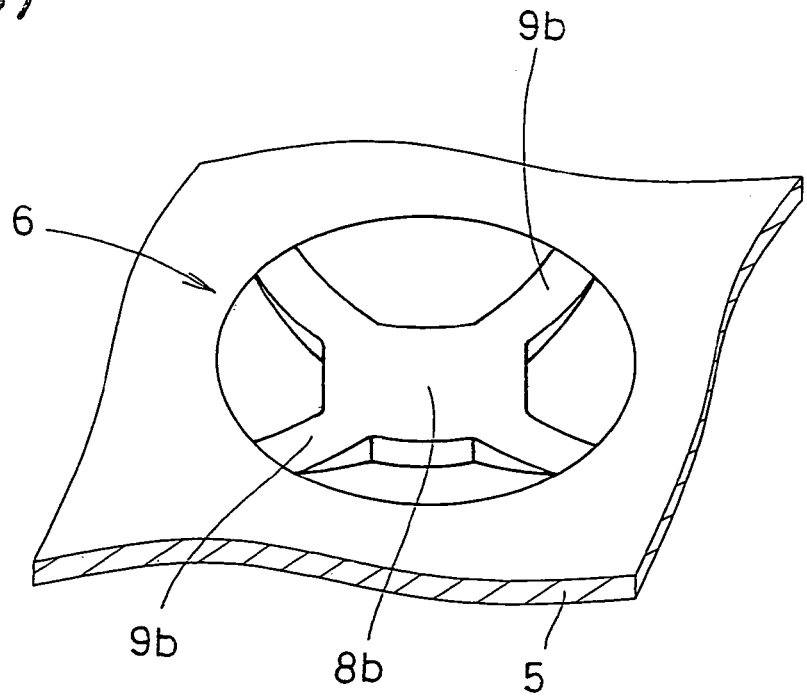

The slip stopper 4 (FIG. 2) is formed by forming a plurality of slip stopping parts 6 in a vertically and horizontally running pattern on a flat steel plate 5. Each slip stopping part 6 (as shown in FIGS. 3(A)–3(C)) has a concave portion 8 and drain channels 9 formed by shear planes 8*a*, 9*a*, described later, in the protruding portion 7 that protrudes in the plate thickness direction from the upper surface 5*a* of the steel plate 5.

Namely, the protruding portion 7 is shaped to be circular in a plan view and have a roughly arc-shaped section, a roughly quadrilateral concave portion 8 is formed at the center of the upper surface side of the protruding portion 7, and the level of the groove bottom portion of this concave portion 8 is designed so as to be higher than the upper surface 5*a* of the steel plate 5. Furthermore, four concave-groove-shaped drain channels 9 that lead to the upper surface 5*a* of the steel plate 5 from the concave portion 8 are radially formed at the upper surface side of the protruding portion 7, however, the groove bottom portions of the drain channels 9 are formed to be inclined from the level which is roughly equal to the upper surface of the concave portion 8 at the concave portion 8 side, become roughly equal to the level of the upper surface of the protruding portion 7, and the upper surface of the upper surface 5*a* of the flat plate 5, at the marginal section of the protruding portion 7, i.e. are highest at the concave portion 8 side and lower toward the marginal side of the protruding portion 7, whereby accumulation of water and dirt in the concave portion 8 is prevented. On the other hand, the lower surface side of the protruding portion 7, portions 8*b*, 9*b*, that are the lower surfaces of the concave portion 8 and the drain channels 9, protrude downward from the protruding portions 7 to be concave, when viewed from below, in a direction opposite to the upper surface side.

Herein, the inner circumferential surface of the concave portion 8 and the groove side surfaces of the drain channels 9 are formed by shear planes 8*a*, 9*a* which face almost perpendicularly to the upper surface 5*a* of the steel plate 5 and are obtained by half blanking that does not open a through hole in the steel plate 5. Furthermore, these shear planes 8*a*, 9*a* are sheared so that the upper edges thereof become acute, that is, acute edges are raised.

In the abovementioned structure, in the slip stopping part 6, a concave portion 8 is formed at the central portion of the protruding portion 7 that protrudes from the upper surface of the steel plate 5 in the plate thickness direction. Further, drain channels 9, shaped as grooves, are formed radially so as to lead to the upper surface 5*a* of the steel plate 5 from the concave portion 8, and the concave portion 8 and drain channels 9 are defined by shear planes 8*a*, 9*a* which face almost perpendicularly to the upper surface 5*a* of the steel plate 5. The shear planes 8*a*, 9*a* are obtained by half blanking that does not open a through hole in the steel plate 5. The shear planes 8*a*, 9*a* can achieve an excellent reliable slip stopping effect because their protrusions extend highly from the steel plate upper surface 5*a* according to the protrusion height of the protruding portion 7, and the upper edges have acute angles. In this embodiment, the angles between each shear plane 8*a* and the upper surface of a protruding portion 7 and between each shear plane 9*a* and the upper surface of the protruding portion 7 become smaller to become a more acute angle as the inclination of the protruding portion 7 increases. Because as these angles become smaller to be a more acute angle, more acute edges can be raised at the upper edges of the shear planes 8*a*, 9*a*, the slip stopping effect can be further improved.

As mentioned above, the present embodiment has a great slip stopping effect, and furthermore, in this embodiment, because the shear planes 8*a*, 9*a* are formed by means of half blanking so as not to open a through hole in the steel plate 5, problems, such as the entry of water or dirt inside the cover 2 or the tool box 3, the blowing-up of heated air from an engine, or external diffusion of noise can be prevented without the conventional double structure with a through hole opened, whereby a significant cost reduction can be achieved.

Furthermore, in this embodiment, because the drain channels 9 are formed to be inclined, the slip stopping effect can be prevented from being lost by accumulation of water or dirt in the concave portion 8, cleaning can be easily carried out even when dirt or dust accumulates in the concave portion 8 or the drain channels 9, and furthermore, because the groove side surfaces of the drain channels 9 are also formed by shear planes 9*a*, the abovementioned slip stopping effect can be further increased.

Figure 5A:
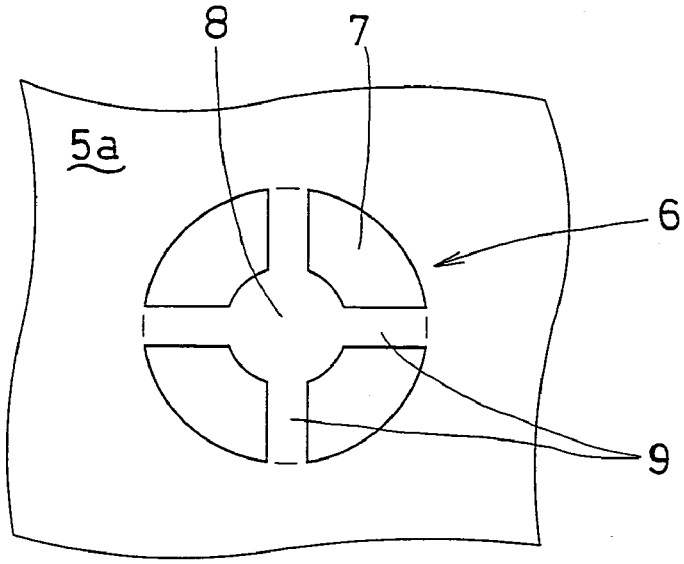
FIGS. 5(A), 5(B), and 5(C) are plan views of slip stopping parts showing second, third, and fourth embodiments, respectively.
Figure 5B:
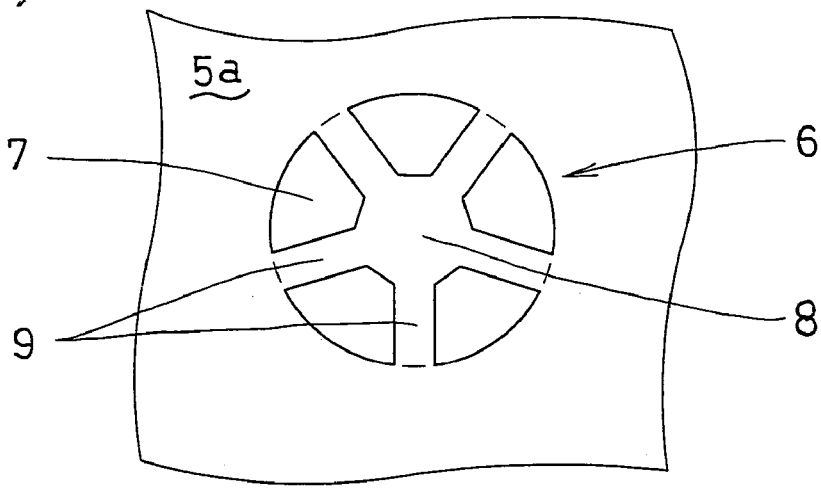
Figure 5C:
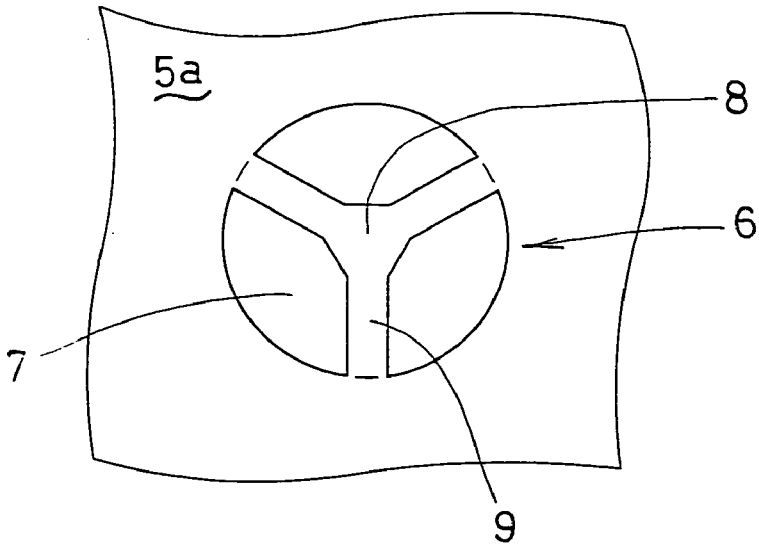
Figure 6A:
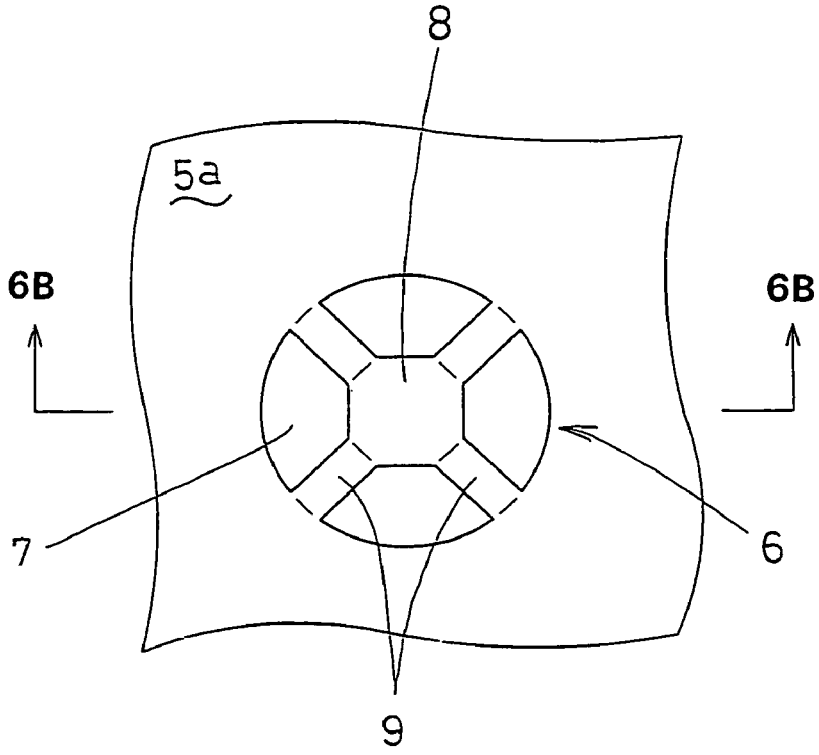
FIG. 6(A) is a plan view of a slip stopping part showing a fifth embodiment.
Figure 6B:
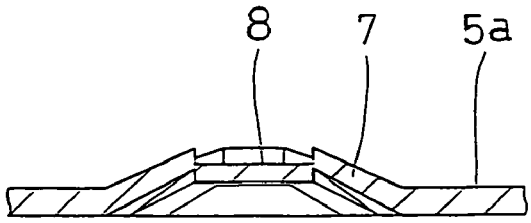
FIG. 6(B) is a 6B—6B sectional view of FIG. 6(A)
Figure 7A:
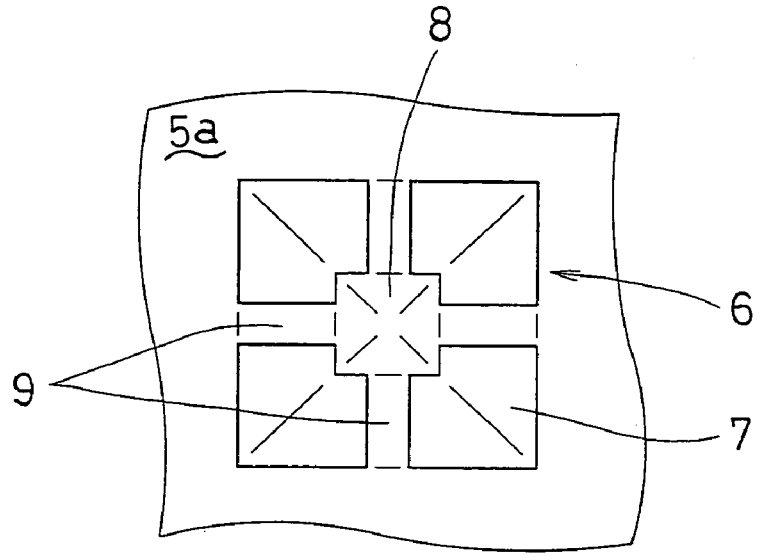
FIGS. 7(A), 7(B), and 7(C) are plan views of slip stopping parts showing sixth, seventh, and eighth embodiments, respectively.
Figure 7B:
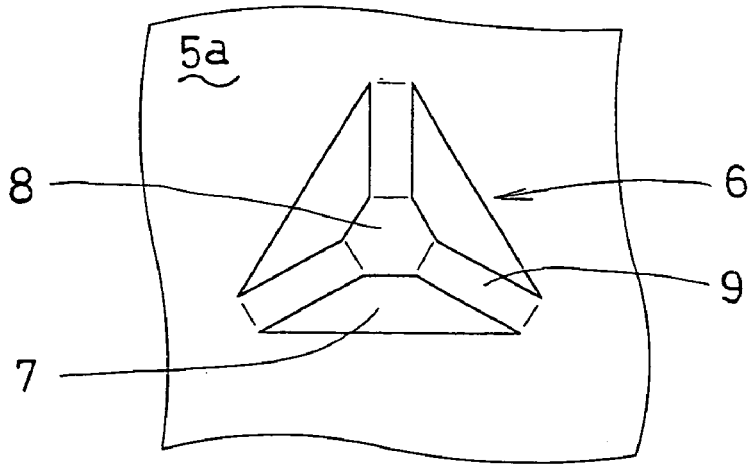
Figure 7C:
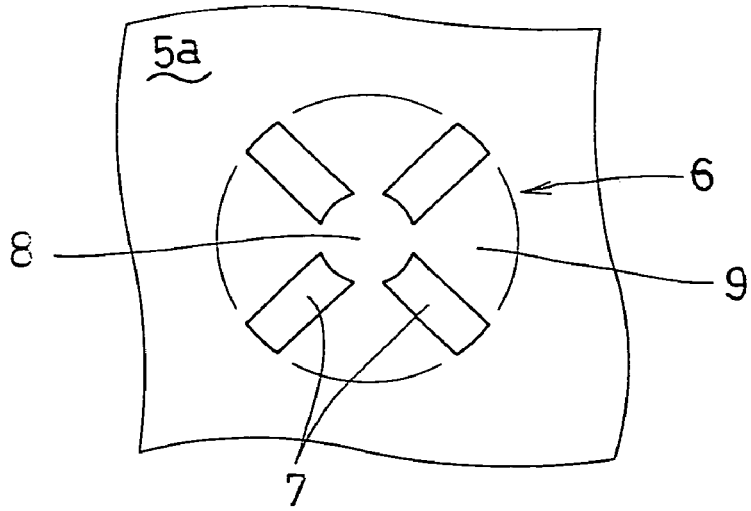
Figure 8:
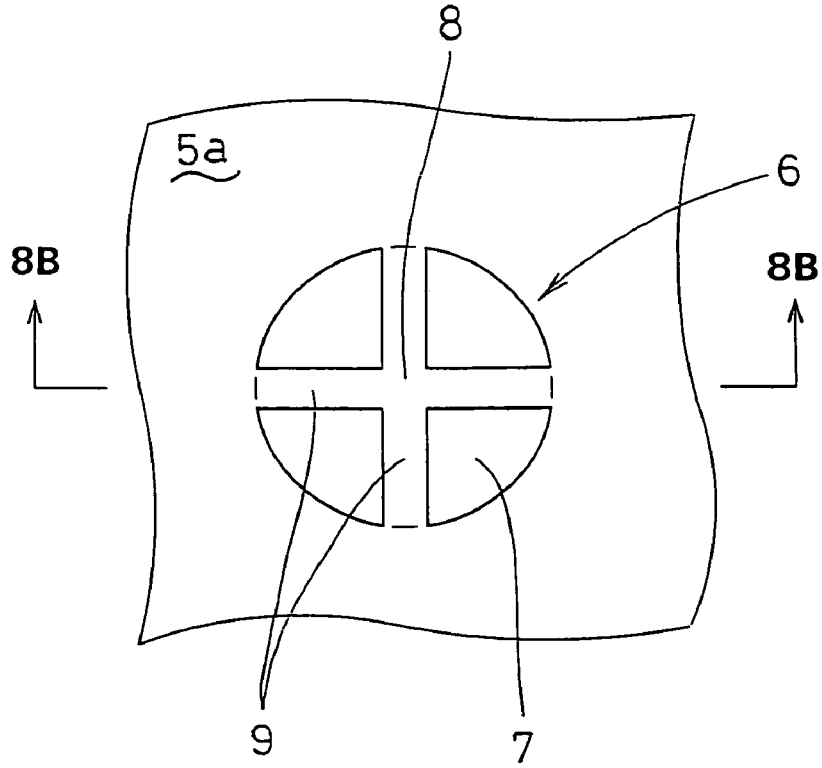
FIG. 8(A) is a plan view of a slip stopping part showing a ninth embodiment.
FIG. 8(B) is an 8B—8B sectional view of FIG. 8(A)
Figure 8:
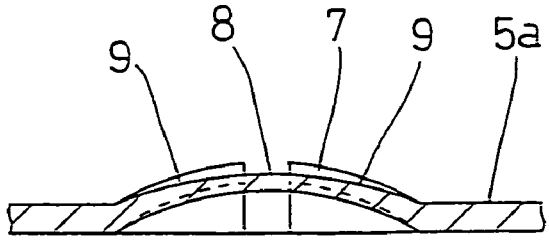
Figure 9:
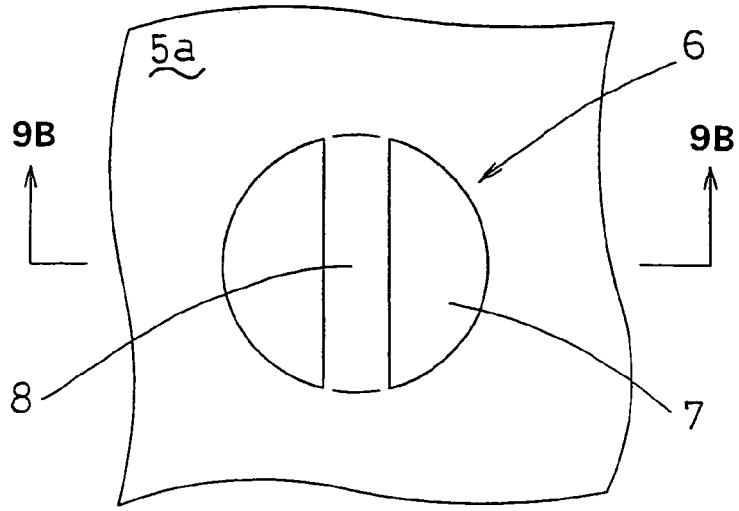
FIG. 9(A) is a plan view of a slip stopping part showing a tenth embodiment.
FIG. 9(B) is a 9B—9B sectional view of FIG. 9(A)
FIG. 9(C) is a drawing showing an example of an arrangement of slip stopping parts of the tenth embodiment.
Figure 9:
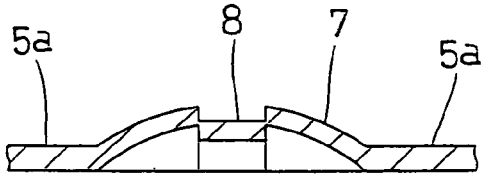
Figure 9:
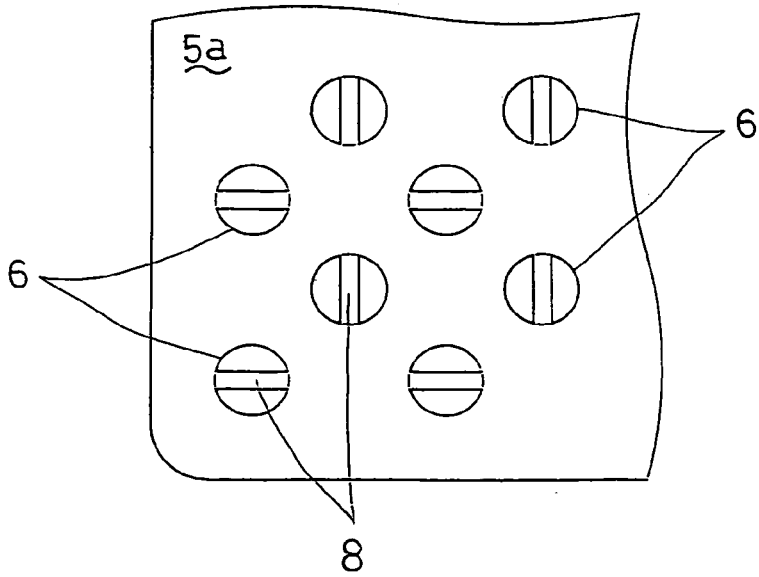

Furthermore, as a matter of course, the slip stopping is not limited to the abovementioned embodiment, but also includes, for example, a second embodiment shown in FIG. 5(A) in which the concave portion 8 is formed to be circular, and third and fourth embodiments, shown in FIGS. 5(B) and 5(C) in which the number of drain channels 9 is increased or decreased and the concave portion 8 may take a polygonal shape with a drain channel 9 at each apex. Furthermore, it is also possible that, as in a fifth embodiment shown in FIGS. 6(A) and 6(B), the protruding portion 7 is formed into a frustum of a cone, or as in the sixth and seventh embodiments, shown in FIGS. 7(A) and 7(B), the protruding portion 7 is formed into a frustum of a square pyramid or a frustum of a trigonal pyramid. Furthermore, as in an eighth embodiment, shown in FIG. 7(C), it is possible that the drain channels 9 are fan-shaped, or as in a ninth embodiment, shown in FIGS. 8(A) and 8(B), the width of the concave portion 8 and the width of the drain channels 9 are set to be equal to each other. Furthermore, it is also possible that, as in a tenth embodiment, shown in FIGS. 9(A) and 9(B), the concave portion 8 is formed across the diameter direction of the protruding portion 7 so as to also serve as a drain channel, and in this case, as shown in FIG. 9(C), by alternately arranging slip stopping parts 9 which have concave portions 8 the direction of which are different from each other, the slip stopping effect can be further improved.

Figure 10A:
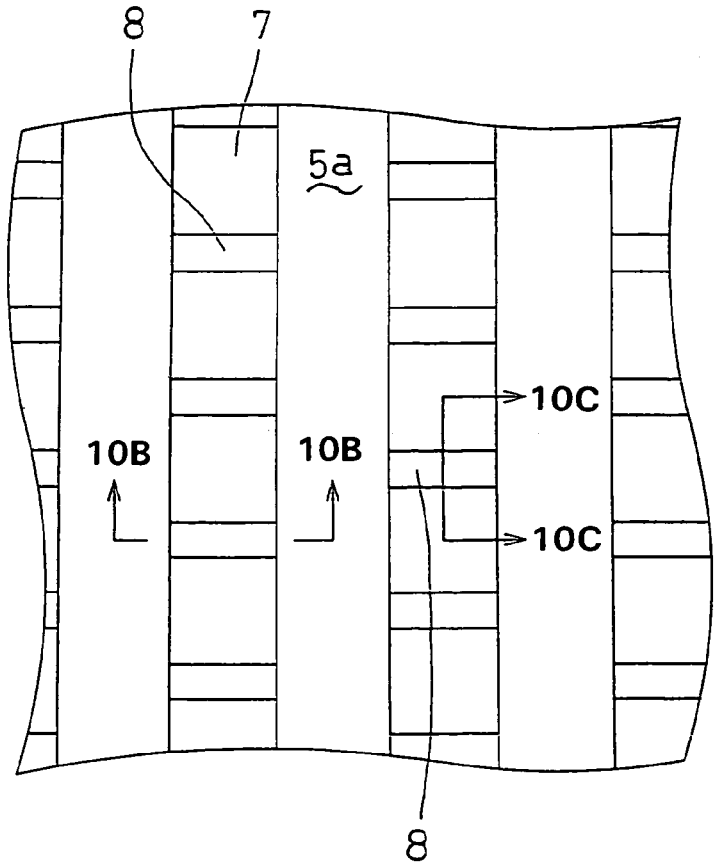
FIG. 10(A) is a partial plan view of a slip stopper of an eleventh embodiment.
Figure 10B:
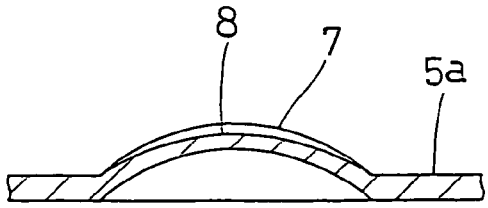
FIG. 10(B) is a 10B—10B sectional view of FIG. 10(A)
Figure 10C:
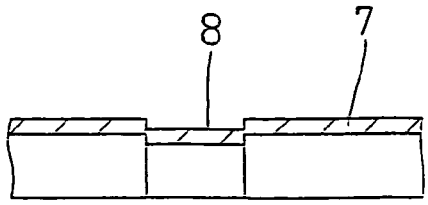
FIG. 10(C) is a 10C—10C sectional view of FIG. 10(A)
Figure 11A:
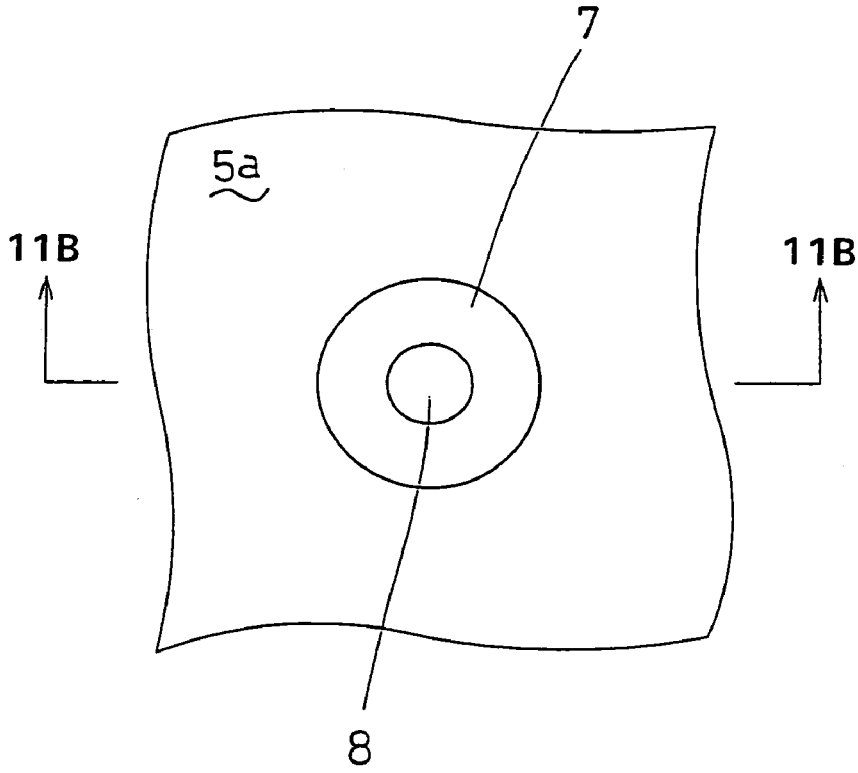
FIG. 11(A) is a plan view of a slip stopping part showing a twelfth embodiment.
Figure 11B:
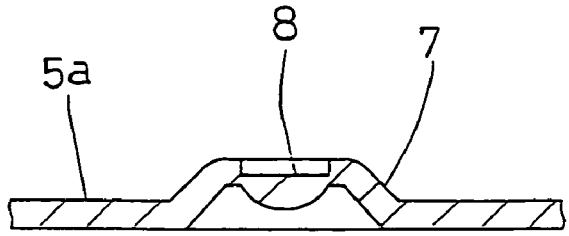
FIG. 11(B) is an 11B—11B sectional view of FIG. 11(A)
Figure 12A:
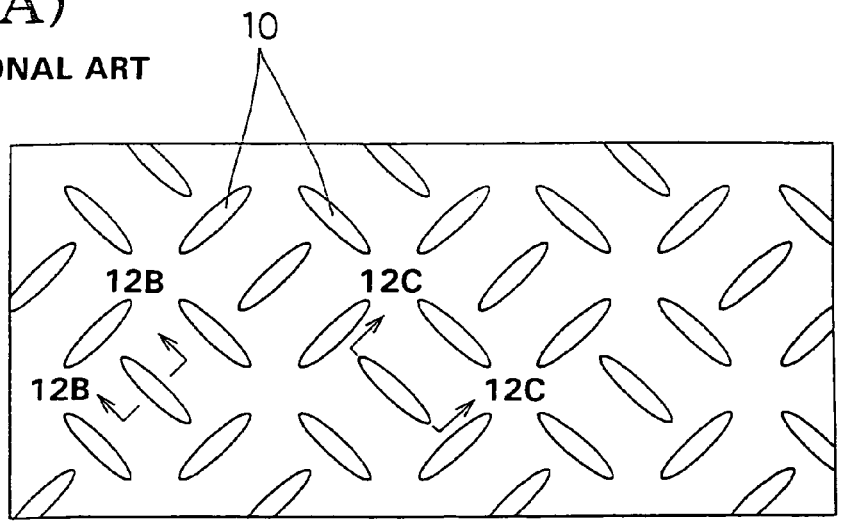
Fig.12(A) CONVENTIONAL ART
FIG. 12(A) is a plan view of a checkered steel plate.
Figure 12B:
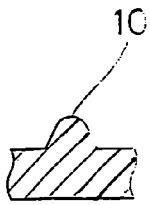
Fig.12(B) CONVENTIONAL ART
FIG. 12(B) is a 12B—12B sectional view of FIG. 12(A)
Figure 12C:
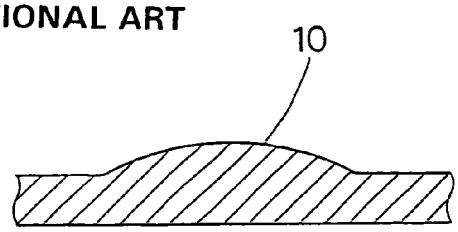
Fig.12(C) CONVENTIONAL ART
FIG. 12(C) is a 12C—12C sectional view of FIG. 12(A)
Figure 13A:
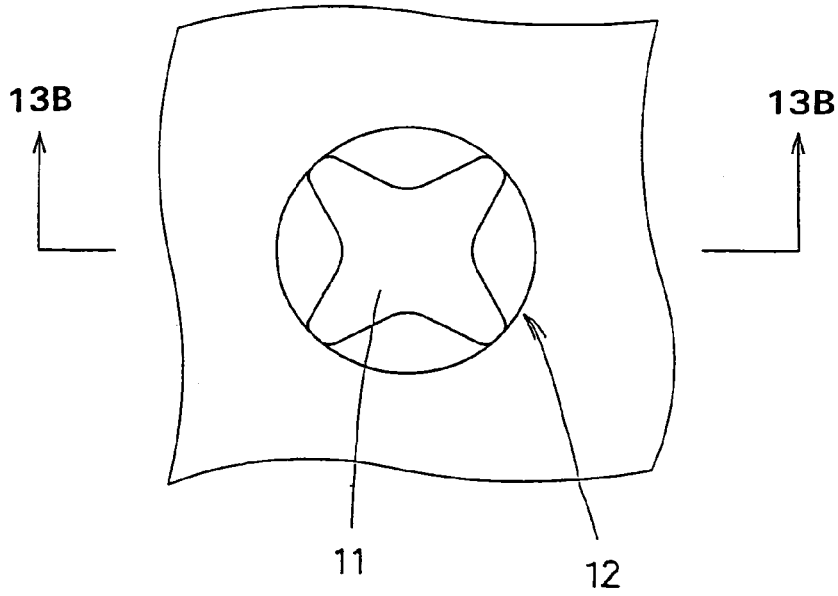
Fig.13(A) CONVENTIONAL ART
FIG. 13(A) is a plan view of a slip stopping part in which a through hole is opened.
Figure 13:
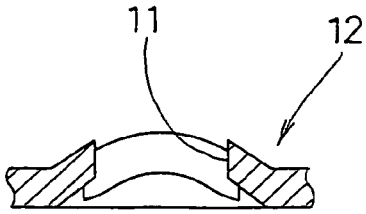
Fig. 13 (B) CONVENTIONAL ART
FIG. 13(B) is a 13B—13B sectional view of FIG. 13(A).

Moreover, the slip stopping concept also includes an eleventh embodiment shown in FIGS. 10(A), 10(B), and 10(C) in which the protruding portion 7 is formed convex, or a twelfth embodiment shown in FIGS. 11(A) and 11(B) in which no drain channels are formed. In FIGS. 5 through 11, the reference numeral 5*a* denotes the steel plate upper surface, 6 denotes the slip stopping part, 7 denotes the protruding portion, 8 denotes the concave portion, and 9 denotes the drain channel. The concave portion 8 and the drain channels 9 are formed by shear planes which are substantially perpendicular to the steel plate upper surface 5*a* and are obtained by half blanking that does not open a through hole in the steel plate.

Furthermore, the invention can be used as slip stoppers not only for stepping surfaces provided on a construction machine, but also for various footings requiring slip prevention, such as floors, passageways, and stairs of buildings, work floors and walkways of ships or special vehicles, nonslip floors of transporters, and scaffolding at construction sites.

What is claimed is:

1. A slip stopper, in which, in front faces of a plurality of protruding portions protruding upwardly from a front face of a plate, concave portions are respectively formed in the plurality of protruding portions by shear planes which extend substantially perpendicular to the plate surface of the plate, each protruding portion has a shape that is high proximate to the center and lowers toward the plate surface of the plate, the concave portions are formed at the center of respective protruding portions in a condition where shear planes are used as inner circumferential surfaces, the concave portions have a closed bottom connected to the shear planes such that open through holes do not occur in the plate, and drain channels shaped into concave grooves lead from the center and lower to the front plate surface with an open and unhindered distal end that communicates with the front plate surface.

2. The slip stopper according to claim 1, wherein the protruding portion is substantially arc-shaped in cross sectional view.

3. The slip stopper according to claim 1, wherein said drain channels are radially formed in a plurality from the concave portion.

4. The slip stopper according to claim 1, wherein side surfaces of the drain channels are formed by shear planes which face almost perpendicularly to the plate surface of the plate.

5. The slip stopper according to claim 1, wherein the slip stopper is used for stepping surfaces provided on construction machines.

6. The slip stopper according to claim 1, wherein the protruding portion is substantially arc-shaped in cross sectional view.

7. The slip stopper according to claim 1, wherein the concave portion is formed at the center of the protruding portion in a condition where shear planes are used as the inner circumferential surfaces.

8. The slip stopper according to claim 3, wherein side surfaces of the drain channels are formed by shear planes which face almost perpendicularly to the plate surface of the plate.

* * * * *